United States Patent [19]

Martin

[11] 4,316,762

[45] Feb. 23, 1982

[54] LABEL APPLICATOR

[76] Inventor: C. Edward Martin, R.R. #2, Shanty Bay, Ontario, Canada

[21] Appl. No.: 58,897

[22] Filed: Jul. 19, 1979

[51] Int. Cl.[3] ..... B65C 3/00; E06B 17/04; B65B 1/04

[52] U.S. Cl. ..... 156/488; 156/492; 156/493; 156/DIG. 41; 156/DIG. 42; 156/215; 53/248

[58] Field of Search ..... 156/185, 187, 202, 212, 156/214, 215, 233, 458, 493, 485, 492, 488, DIG. 13, DIG. 42, DIG. 41; 53/248, 260, 261, 262, 263, 264, 359, 499; 15/97 R, 97 B, 103, 104 S, 250.2, 250.35, 250.38

[56] References Cited

U.S. PATENT DOCUMENTS

| | | | |
|---|---|---|---|
| 1,469,599 | 10/1923 | Johnson et al. | 156/DIG. 42 |
| 2,652,941 | 9/1953 | Carter | 156/493 |
| 3,273,308 | 9/1966 | Hoette | 53/261 |
| 3,298,889 | 1/1967 | Carter | 156/492 |
| 3,428,995 | 2/1969 | Pollock | 15/250.35 |
| 3,788,,034 | 1/1974 | Hartness | 53/262 |
| 4,097,355 | 6/1978 | Schnier | 156/215 |

FOREIGN PATENT DOCUMENTS

| | | | |
|---|---|---|---|
| 2629 | of 1888 | United Kingdom | 156/492 |

*Primary Examiner*—Edward C. Kimlin
*Assistant Examiner*—L. Falasco
*Attorney, Agent, or Firm*—Hirons, Rogers & Scott

[57] ABSTRACT

The invention provides apparatus for labelling containers such as bottles and for placing groups of the containers in a crate. A labelling station includes an arm having at least two label-engaging portions separated by resilient neck portions which permit flexing as labels are placed on the container by the label-engaging portions. Also a bottle delivery system is provided having guide elements for grouping in fours. Each group guides a bottle into a pocket of a crate.

4 Claims, 8 Drawing Figures

LABEL APPLICATOR

This invention relates to container handling equipment and more specifically to apparatus used to apply labels to containers such as bottles after filling the containers and to guide the containers into boxes or crates.

The present invention has applications for use in handling a variety of containers. However it is primarily directed to handling glass bottles of the type requiring labels. For the purposes of description, such bottles will be described as being exemplary of containers generally. It will become evident from the description related to bottles that other containers could also be handled for label application only, for placing the containers in crates or for both functions.

It is common practice to attach labels to bottles to identify the product and to apply the necessary information prescribed by law. Quite often a label is applied to a lower or main portion of a bottle and a further label is added where the bottle tapers upwardly towards the neck. Further, in some instances a third label is applied at the neck of the bottle.

In general, the labels are applied as the bottle is moving from a filling and capping station to a bottle delivery system where groups of bottles are placed simultaneously in a crate. In order that the productivity of the system be maintained, it is essential that the labels be applied expeditiously and that breakdowns in the equipment be kept to a minimum. It will be appreciated that glass bottles are both irregular and subject to breakage. The equipment used to locate the labels must operate irrespective of these irregularities and should be arranged to minimize impact with the bottles which could cause breakage. Also, it should be possible to modify the equipment quickly to accommodate different sizes of bottles and the parts needed for such modifications should be inexpensive and readily available.

In practice, the equipment presently used to apply labels includes an arm made up of several metal parts (usually brass) hinged to one another and sprung in an attempt to allow for the irregularities in bottle shapes. The arms are expensive, and because of the moving parts the arms can become jammed particularly if a bottle should break adjacent one of the arms.

Although the present equipment has been used for many years, it suffers from several major disadvantages. Firstly it is expensive and if the equipment is to be used for many different sizes of bottles, then a large investment is necessary in arms of different shapes. Also, although when in good condition the arms will match bottles having minor irregularities, it has been found that the irregularities found in bottles, particularly larger bottles, are such that the equipment cannot be relied upon and an operator must continue to check to ensure that the bottles are receiving labels. Further, the equipment is particularly troublesome when a bottle requires three different labels.

The present invention, in one of its aspects, is intended to provide an improved arm capable of applying labels to glass bottles and other similar containers and particularly to bottles suffering from significant irregularities. Accordingly in this aspect the invention provides a label locating arm for use in attaching at least two labels to containers such as bottles. A first of the labels is located below a second when placed on respective first and second surfaces of the container. The arm comprises a lower portion for use in placing the first of the labels and an upper portion for use in placing the second of the labels. The lower and upper portions have respective leading faces shaped for face-to-face engagement with respective first and second surfaces of the container. The first face normally is displaced slightly from said first surface when the second face and second surface are in face-to-face engagement to thereby ensure engagement of the second face with the container before engagement by the first face. The arm also includes an integral neck portion between the upper and lower portions for flexing to permit engagement of the first face after the said engagement of the second face upon application of force to bring the container and arm towards one another. The arm is of synthetic plastic material exhibiting sufficient resilience to permit said flexing and to return substantially to its original shape upon removing the force.

Equipment for filling, labelling and packaging bottles usually includes a last station where the bottles are placed in crates. Groups of bottles are located above a crate, the crate is moved upwardly and then the bottles are dropped into the crate. As the bottles drop, there is a possibility that they may deflect and miss the pockets in the crate. If this happens in automatic machinery one of the bottles may be left on top of the crate and this will interfere with the equipment resulting in breakage both to the bottles and possibly to the equipment. In an attempt to avoid this, various structures have been provided which guide the bottles as they fall downwardly in an attempt to ensure that the bottles enter the corresponding pockets in the crate.

The most common form of bottle guide consists of a series of guide elements in groups arranged so that there are four elements above each pocket. Normally the elements in a group meet at their lower extremities over the centre of the pocket so that when the bottle falls, the elements are deflected outwardly into corners of the pockets. These elements thus serve both to absorb some of the energy of the bottle falling and also to guide the bottle into the pockets. The elements are rigid and spring mounted at their tops to provide the needed resilience. This arrangement tends to be expensive, and should anything go wrong with any one of the elements it is necessary to remove all of the equipment for repair and to replace it with a preassembled set of elements. A further difficulty arises should one of the elements for some reason become displaced. Before the bottles are dropped, the crate is moved upwardly so that the elements would normally be positioned inside the pockets. Should one of the rigid elements be in an improper position, the crate will deflect the element with resulting breakage. The element must then be replaced because the equipment will not function unless all of the elements are operational.

Accordingly, in a second aspect, the present invention is intended to provide locating arms for use in guiding bottles or similar containers as they fall downwardly into pockets of a crate. It is intended that these arms will absorb shocks, can be deflected improperly without breakage, and yet will continue to serve to guide bottles after such improper deflections. Accordingly, in this second aspect, the invention provides a guide element for use in directing a generally cylindrical container such as a bottle as it falls from a delivery system into a generally square pocket of a crate. The guide element has an upper end portion adapted to be rigidly attached to the delivery system at a location above a corner of said pocket, and an elongated limb inclined downwardly from the end portion and terminating above a centre of the pocket. The limb has a surface on which the container can slide as it moves downwardly and the element is of a synthetic plastic material exhibiting sufficient resilience to permit it to flex into the corner of the pocket as the container moves downwardly into the pocket. Upon releasing the arm from the pocket the arm will return substantially to its original shape ready to guide another container into the pocket.

BRIEF DESCRIPTION OF DRAWINGS

These and other aspects of the invention will be better understood with reference to the drawings, in which:

Reference is made first to FIG. 1 which is included to illustrate the use of label locating arms according to the invention. The structure apart from these arms is conventional and has been simplified in this view so that its description is minimized and is included purely to describe the function and use of the locating arm. As seen in FIG. 1, a labelling station designated generally by numeral 20 receives glass bottles from a first or delivery conveyor 22 and after they receive labels, the bottles exit on a second conveyor 24. The bottles are carried through the labelling station 20 on a turntable 26 driven from a central shaft 27. Each of the bottles stands against one of five equally spaced stops 28 attached to the turntable 26.

As shown in FIG. 1, the bottles are at different stages in the process of receiving labels. Firstly, a bottle is shown in ghost outline where the labels will be supplied to the bottle as will be described in more detail with reference to FIGS. 2 and 3. Subsequently, and after receiving labels which are held in place by label locating arm 30, the bottle moves on until it takes up the position represented by bottle 32. At this point the bottle is about to engage between outer and inner curved brushes 34, 36 arranged about the annular path followed by the bottle. The brushes sweep the bottom label into engagement with the surface of the bottle and as the bottle continues along the path it comes to a position where it is also between an upper pair of brushes 38, 40. These brushes are inclined so that they sweep an upper label about a portion of the bottle adjacent the neck of the bottle. Subsequently the bottle exits from between the brushes and the label locating arm moves ahead of the bottle so that the bottle is permitted to engage in guides which deflect the bottle onto the second conveyor 24.

The conventional system for moving the arms 30 is not shown in detail because it is not relevant to the claimed invention. For the purposes of illustrating the equipment however the turntable 26 is shown to have a series of curved slots 41 each of which contains one of the arms. These slots combine with equipment under the turntable to cause the arms first of all to move into engagement with a bottle to retain labels, to remain in this position through the brushes 34 to 40 and then to move ahead of the bottles out of engagement so that the bottle can leave the turntable.

Figure 1:
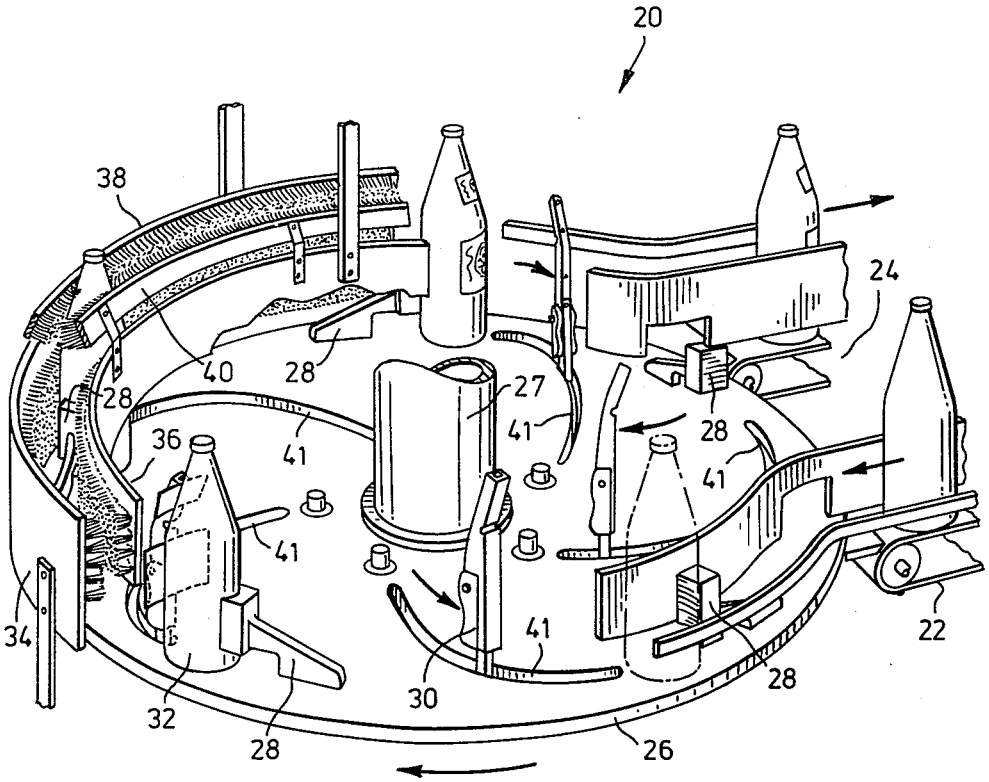
FIG. 1 is a diagrammatic perspective view of parts of a labelling station incorporating a preferred embodiment of label locating arms according to the invention and forming part of equipment used to fill and package bottles in crates, the labelling station receiving filled bottles and applying labels before the bottles proceed to a mechanism used to place groups of bottles in crates.
Figure 2:
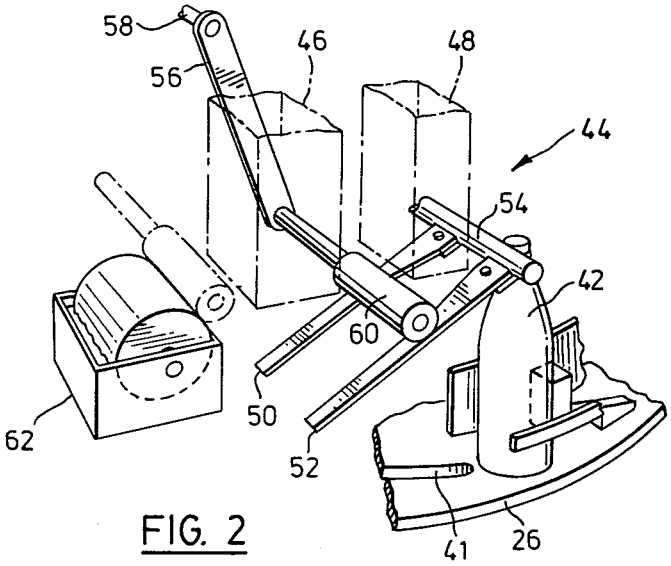
FIG. 2 is a perspective view of a label applicator forming part of the labelling station and shown about to handle a label.
Figure 3:
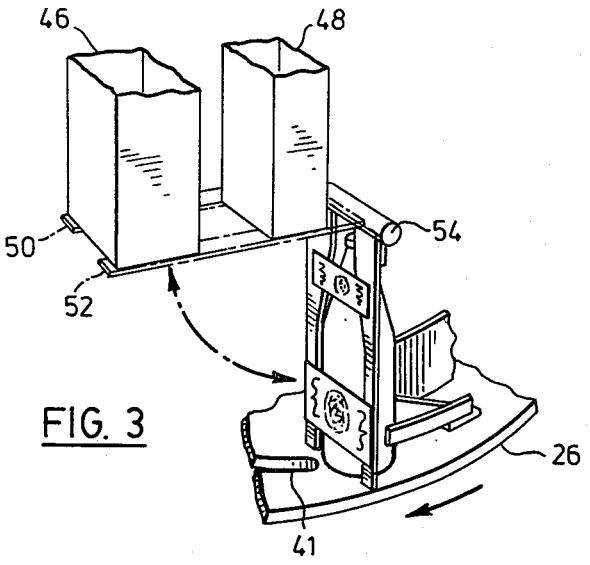
FIG. 3 is a view similar to FIG. 2 and showing the label applicator positioning two labels on a bottle at the labelling station.

For the purpose of understanding the use of the arms, the equipment used to place labels will be described with reference to FIGS. 2 and 3. As seen in FIG. 2, a bottle 42 which corresponds to that shown in ghost outline in FIG. 1 is positioned adjacent a label applicator designated generally by the numeral 44. This applicator includes a pair of label dispensing bins 46, 48 shown in ghost outline and positioned to apply labels to a pair of arms 50, 52 which move in unison with a pivotal shaft 54. As the bottle approaches the label applicator, a link 56 is driven by a shaft 58 to carry a roller 60 into engagement with an adhesive dispenser 62. The movement of this roller is controlled relative to movement of the shaft 54 so that upon leaving the dispenser 62 the roller meets the arms 50, 52 and applies adhesive as it returns to the position shown in FIG. 2. Subsequently the roller moves back to a rest position against the adhesive dispenser and the arms 50, 52 carry on upwardly into contact with labels at the bottoms of bins 46, 48. As a result these labels are temporarily adhered to the wet adhesive on the arms and carried by the arms downwardly into engagement with the bottle 42. Of course the centers of the labels have no adhesive and the labels must be retained in contact with the bottle until such time as the labels can be wrapped against the bottle by brushes 34 to 40 (FIG. 1).

The arms 50, 52 remain in this position while the bottle is carried by the turntable between the arms. At the same time the label locating arm 30 (FIG. 1), which is not seen in FIG. 3, is brought into engagement at the end of the slot 41 to retain the labels against the bottle. Consequently when the bottle moves through the space between the arms 50, 52 the labels are stripped off the arms. The bottle together with the arm 30 continues to move carried by the turntable with some bias between the arm and the bottle to retain the labels as will be described with reference to FIGS. 4 and 5.

The arm 30 is mounted on the upper end of an arm 64, to which the arm 30 is secured by means of a bolt 66 and an associated nut and a screw 68. The arm 30 has a lower portion 70 and an upper portion 72 which are connected by an integral neck portion indicated generally by reference numeral 74.

The arm 30 is provided with a metal reinforcing strip 80 extending between side walls 76 and 78 and secured to the arm 30 by screws 82 and, at the opposite side of the arm, with faces 84 and 86 for engagement with corresponding faces of the bottle, the face 86 being inclined relative to the face 84 for engagement with an inclined shoulder 88 of the bottle. The faces 84 and 86 serve to retain respective labels 92 and 90 against the bottle.

The face 84 is normally displaced slightly from the bottle surface when the face 86 engages the surface 88 in face-to-face engagement to thereby ensure engagement of the face 86 with the bottle before engagement of the bottle by the face 84. The neck portion 74 flexes to permit the engagement of the face 84 after the engagement of the face 86, the arm 30 being of synthetic plastic material exhibiting sufficient resilience to permit such flexing and to return substantially to it's original shape subsequently.

The arm described with references to FIGS. 1 to 5 is preferably of an ether based polyurethane having a Shore "A" hardness of 85 to 90. A suitable material is sold by Prothane Ltd. in Canada under the designation "Prothane 411". In general any material having comparable physical characteristics will be acceptable. These characteristics include resistance to permanent deformation combined with flexibility, as well as an overall resistance to fatigue failure caused by repeated limited bending interspersed with occasional acute bending.

Figure 4:
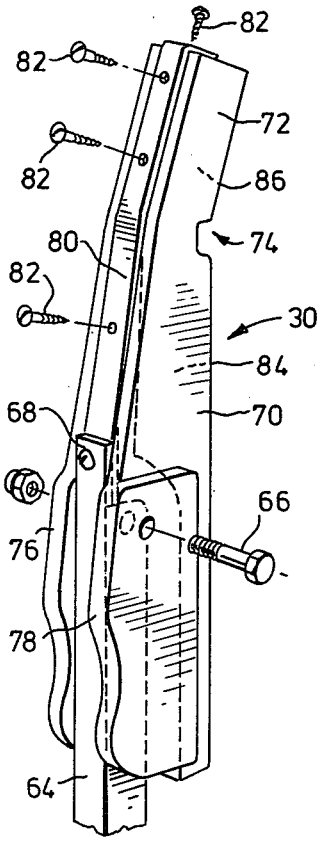
FIG. 4 is a perspective view from the rear of a preferred embodiment of a label locating arm used in the labelling station to retain the labels on a bottle after the bottle receives the labels from the label applicator.

The reinforcing strip 80 best seen in FIG. 4 is used to enhance the resilience of the preferred embodiment shown in the drawings. However it has been found that satisfactory performance can be achieved using arms without the reinforcing strip although it is anticipated that the reinforcing strip will result in increased life and faster reaction to returning to a normal position.

Figure 5:
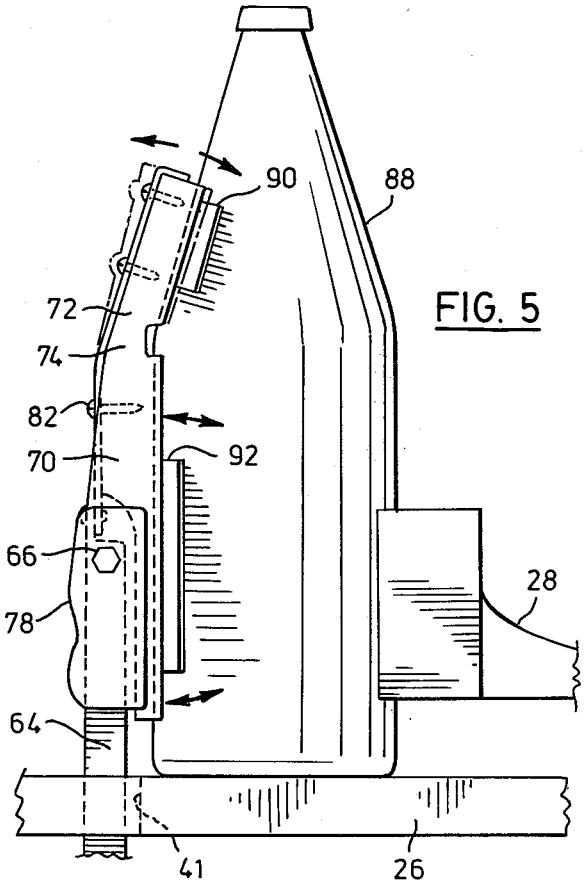
FIG. 5 is a side view of the label locating arm positioned against a bottle and retaining labels on the bottle.

The label locating arm can also be used to apply neck labels if required in particular situations. Sometimes a bottle is shaped with a neck of generally cylindrical form which blends into a tapered portion terminating in an enlarged cylindrical main portion at the bottom of the bottle. Some products require a first label at the neck, another on the tapered portion and a third on the main body. This is done by extending the arm shown in the drawings to include a top portion which corresponds to the neck of the bottle and a weakened (or further neck portion) above the upper portion 72. In such a situation the arm is designed so that when it is brought into contact with a bottle the top portion engages the neck of the bottle first, there is then some deflection before the tapered portion is engaged, and after further deflection the main body of the bottle is engaged. There is consequently positive force between the arm and the bottle at three locations so that all three labels can be retained against the bottle in similar fashion to that described with respect to the labels 90 and 92 (FIG. 5).

It will also be appreciated that the natural resilience of the material used to make the arms is advantageous when handling glass containers. The arm is shaped so that it fits snugly against the container and irregularities in the outer surface and in the curvature of the container can be accommodated due to the resilience of the arm. Should there be impact between the arm and the container there is less likelihood of breakage due to the energy absorption as the arm deforms. All of these characteristics combine to result in an arm which is a significant improvement in the art.

It will now be appreciated that the description of the glass bottle is exemplary. Although the arm is especially useful for applying labels to such bottles, it can be used wherever similar problems exist. The arm would of course be shaped to match the container.

Figure 6:
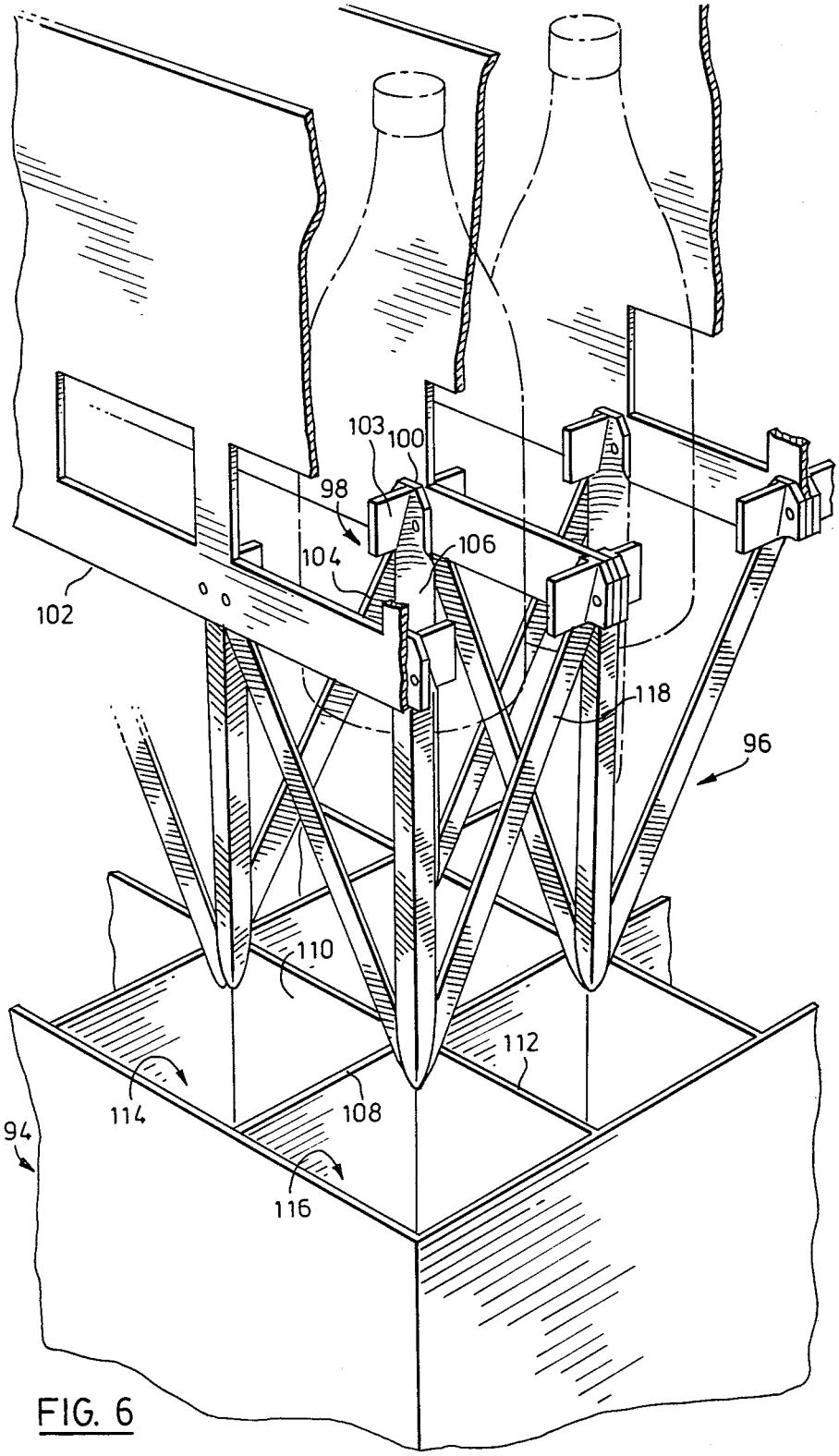
FIG. 6 is a diagrammatic perspective view showing the major parts of a bottle delivery system having guide elements for directing bottles into pockets of a crate also seen in this view.

Reference is next made to FIG. 6 to describe a preferred embodiment of a second aspect of the invention. FIG. 6 is an incomplete view of a bottle delivery system used to deposit bottles in a crate 94 and is intended to illustrate the use of the inventive guide element designated generally by the numeral 96. These elements are used to guide bottles (shown in ghost outline) as they drop vertically into pockets in the crate 94.

A typical one of the guide elements 96 is indicated by numeral 98. This element includes a head 100, by which the element is fixedly attached to superstructure 102, a projection 103, and a pair of flexible limbs 104, 106 which diverge as they incline downwardly. The head 100 of the element 98 is located above a wall 108 of the crate 94 where this wall intersects with walls 110 and 112 and the projection 103 is in line with the wall. In effect, the head 100 is above adjacent corners of pockets 114 and 116. The limb 104 inclines downwardly terminating generally above the center of pocket 114 whereas the limb 106 terminates above the center of pocket 116. Here the limbs meet other limbs so that there are in fact four limbs meeting above the center of each pocket. In some instances, a limb may extend from a head which is associated only with that limb. One example of this is the end element 118. Nevertheless in all instances the heads of the elements are located generally above the corners of pockets above which limbs from these elements congregate at the center.

Consider the pocket 116. When the bottle falls it is guided initially by four projections such as projection 103 and then by four limbs above this pocket. Also, due to the fact that the limbs are resilient, they can be deflected by the weight of the filled bottle until the bottle passes between them into the pocket 116. As will be described later, the crate is moved upwardly until the limbs are within the pockets and then they are deflected by the bottles into the corners of the pockets. Subsequently the limbs are released from the pocket as the crate moves downwardly carrying with it the bottles. Due to the resiliency of the arms they return to the position shown in FIG. 6 ready to guide the next group of bottles into the pockets.

The function of the limbs of the elements is two-fold. Firstly, as the bottles fall, energy is transferred from the falling bottle to the limbs to deflect the limbs. This tends to restrain the bottle preventing free fall and at the same time, the bottle is guided towards the center of the pocket. It will be evident that in equipment of this type there is the possibility that something will not work properly. For instance, if a bottle breaks it is possible that the arms will be deflected abnormally and in extreme cases be deflected outside the crate so that when the crate moves upwardly the arms may be doubled over. This would break the arms but for the fact that their resiliency permits abnormal bending. Within a very short time the arms return to their original condition ready for further use. This avoids down time and results in more continuous use of the bottling equipment.

Figure 7:
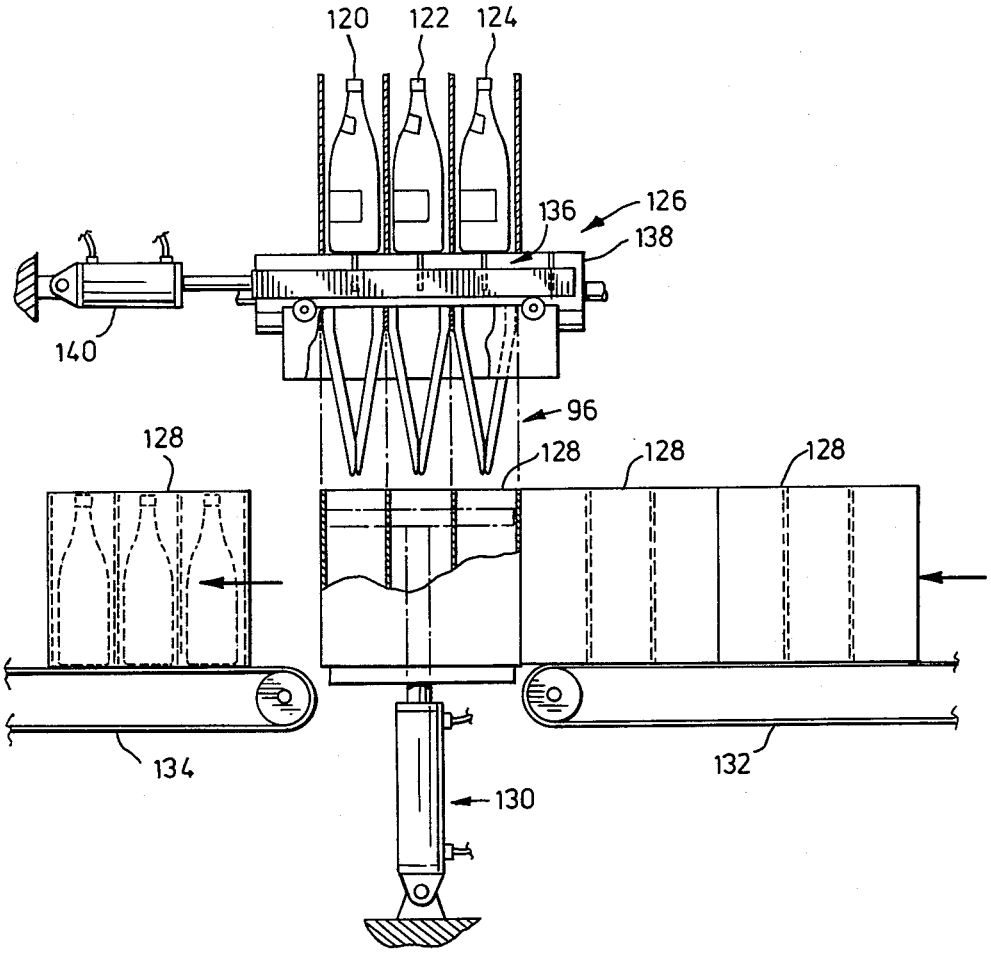
FIG. 7 is a side view of the structure shown in FIG. 6 and also illustrating a bottle release mechanism and conveyor systems for moving crates.
Figure 8:
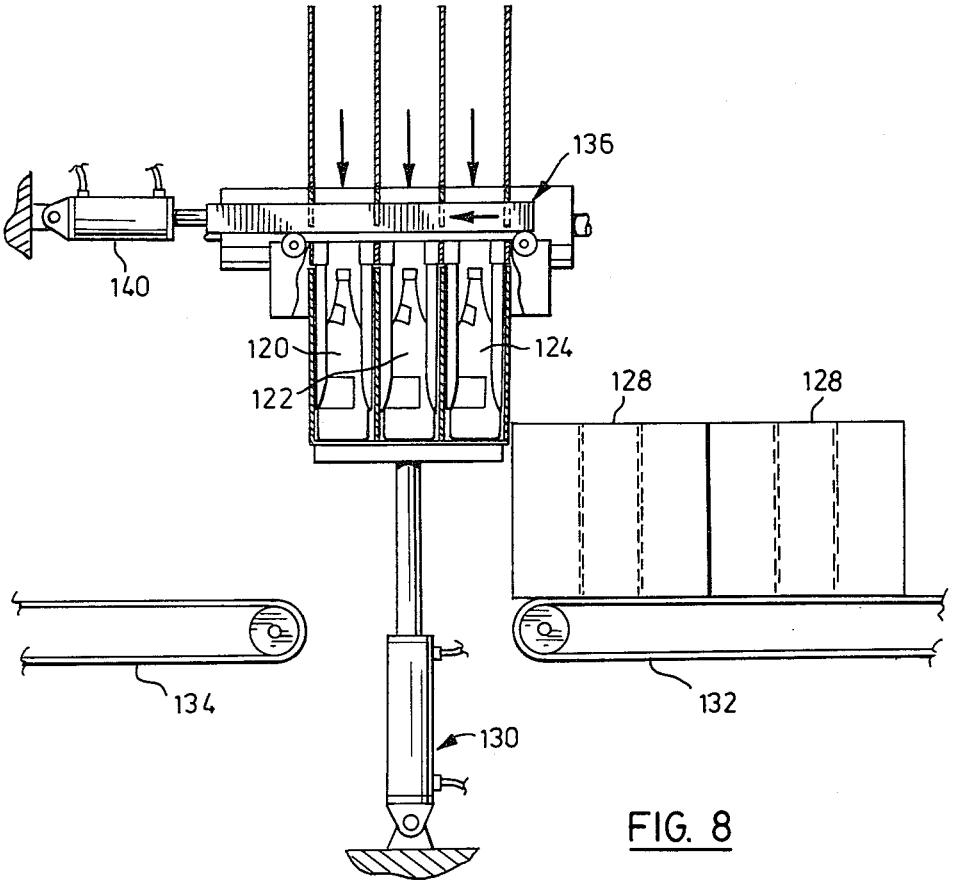
FIG. 8 is a view similar to FIG. 7 showing the bottles after they have been deposited in a crate.

A more thorough description of the use of the elements 96 will now be developed with reference to FIGS. 7 and 8. As seen in FIG. 7 rows of bottles 120, 122, and 124 are brought by conveyor to a position in the bottle delivery system designated generally by the numeral 126. It will be presumed for the purpose of illustration that the bottles are being placed in crates 128 each of which is adapted to contain six bottles in two rows of three. The bottle delivery system 126 is therefore supporting six bottles ready to fall among the elements 96 into one of the crates 128 immediately below. This crate rests on an elevator 130 positioned between delivery and removal conveyors 132, 134. Suitable stop systems (not shown) are used to maintain the crates in position while the crate on the elevator 130 receives bottles from the system 126.

Delivery system 126 includes a grid 136 on which the bottles rest in the position shown in FIG. 7. This grid is movable relative to a main body 138 by energizing a double-acting actuator 140 to move the grid towards the actuator and to expose square openings below the bottles so that the bottles are free to fall downwardly towards the elements 96. However before this happens, the elevator 130 is energized to lift the crate up to a position shown in ghost outline where the elements 96 are contained within pockets in the crate. At this point the actuator 140 is made to move the grid 136 sideways whereupon the bottles fall among the elements 96 deflecting them into the corners of the pockets and allowing the bottles to be positioned in the pockets as seen in FIG. 8. As soon as this is completed the actuator 130 is energized to lower the filled crate and the stop system permits this crate to be pushed onto the removal conveyor 134 as a new and empty crate is positioned on the elevator 130. The procedure is then repeated to fill the empty crate.

The preferred embodiment of the elements 96 includes limbs which are shaped to fit in corners of the pockets about the bottles. Consequently the faces adjacent the bottles are concave whereas the faces in the pockets are at right angles to one another. The general triangular cross-section therefore includes one curved face to accommodate the bottle.

The elements 96 are preferably of an ether based polyurethane having a Shore "A" hardness of 85 to 90. A suitable material is sold by Prothane Ltd. in Canada under the designation "Prothane 411". In general any material having comparable physical characteristics will be acceptable. These characteristics include resistance to permanent deformation combined with flexibility, as well as an overall resistance to fatigue failure caused by repeated limited bending interspersed with occasional acute bending.

What we claim as our invention is:

1. A label locating arm for use in attaching at least two labels to containers such as bottles, a first of the labels being located below a second when placed on respective first and second surfaces of the container, the arm comprising: a lower portion for use in placing the first of the labels and an upper portion for use in placing the second of the labels, the lower and upper portions have respective first and second leading faces shaped for face-to-face engagement with respective first and second surfaces of the container, the first face normally being displaced slightly from said first surface when the second face and second surface are in face-to-face engagement to thereby ensure engagement of the second face with the container before engagement by the first face, the arm also including an integral neck portion between the upper and lower portions for flexing to permit engagement of the first face after the said engagement of the second face upon application of force to bring the container and arm towards one another, and being of synthetic plastic material exhibiting sufficient resilience to permit said flexing and to return substantially to its original shape upon removing the force.

2. A label locating arm as claimed in claim 1 and further including a metal reinforcing strip extending between the upper and lower portions remote from the said leading faces to add resilience and stability to the arm.

3. A label locating arm as claimed in claim 1 in which the lower portion defines openings for mounting the arm on a horizontal pin with the pin extending generally parallel to said leading faces.

4. Apparatus for handling containers such as bottles, the apparatus including a labelling station having a plurality of locating arms for use in attaching labels to the containers, a first of the labels being located below a second when placed on respective first and second surfaces of the container, and the arm comprising: a lower portion for use in placing the first of the labels and an upper portion for use in placing the second of the labels, the lower and upper portions have respective leading faces shaped for face-to-face engagement with respective first and second surfaces of the container, the first face normally being displaced slightly from said first surface when the second face and second surface are in face-to-face engagement to thereby ensure engagement of the second face with the container before engagement by the first face, the arm also including an intergral neck portion between the upper and lower portions for flexing to permit engagement of the first face after the said engagement of the second face upon application of force to bring the container and arm towards one another, and being of synthetic plastic material exhibiting sufficient resilience to permit said flexing and to return substantially to its original shape upon removing the force; and the apparatus further including a bottle release mechanism for permitting a plurality of the containers to fall into a crate and for guiding the containers as they fall into respective pockets in the crate, the bottle release mechanism including a plurality of resilient limbs of synthetic plastic material rigidly coupled to one another and arranged in groups so that each group consists of four limbs meeting at their lower extremities and diverging upwardly, there being as many groups as pockets in the crate and the locations of the groups corresponding to the pockets whereby as bottles fall towards respective pockets in the crate some of the energy is absorbed in deflecting the limbs outwardly so that the bottles are guides into the pockets.

* * * * *